US010323494B2

(12) United States Patent
Joshi et al.

(10) Patent No.: US 10,323,494 B2
(45) Date of Patent: Jun. 18, 2019

(54) HYDROCARBON PRODUCTION SYSTEM AND AN ASSOCIATED METHOD THEREOF

(71) Applicant: General Electric Company, Schenectady, NY (US)

(72) Inventors: Mahendra Ladharam Joshi, Katy, TX (US); Xuele Qi, Edmond, OK (US); Raymond Patrick Murphy, Waddell, AZ (US); Stewart Blake Brazil, Edmond, OK (US); Haifeng Jiang, Edmond, OK (US); Dewey Lavonne Parkey, Jr., Oklahama City, OK (US)

(73) Assignee: General Electric Company, Schenectady, NY (US)

( * ) Notice: Subject to any disclaimer, the term of this patent is extended or adjusted under 35 U.S.C. 154(b) by 246 days.

(21) Appl. No.: 15/196,737

(22) Filed: Jun. 29, 2016

(65) Prior Publication Data

US 2017/0022797 A1 Jan. 26, 2017

Related U.S. Application Data

(60) Provisional application No. 62/195,814, filed on Jul. 23, 2015.

(51) Int. Cl.
*E21B 43/38* (2006.01)
*E21B 43/40* (2006.01)
(Continued)

(52) U.S. Cl.
CPC ..... *E21B 43/38* (2013.01); *E21B 43/385* (2013.01); *E21B 43/40* (2013.01); *E21B 43/124* (2013.01);
(Continued)

(58) Field of Classification Search
CPC ..... E21B 43/38; E21B 33/12; E21B 43/40; E21B 34/06; E21B 43/10; E21B 43/124;
(Continued)

(56) References Cited

U.S. PATENT DOCUMENTS 4,296,810 A 10/1981 Price
4,913,630 A 4/1990 Cotherman et al.
(Continued)

FOREIGN PATENT DOCUMENTS

CA 2096888 A1 11/1993
CN 202417467 U 9/2012
(Continued)

OTHER PUBLICATIONS

Mahendra L. Joshi et al., Dec. 21, 2015, U.S. Appl. No. 14/975,915.
(Continued)

*Primary Examiner* — Michael R Wills, III
(74) *Attorney, Agent, or Firm* — Baker Hughes Patent Operations

(57) ABSTRACT

A system includes a casing-liner, a first downhole separator, a production pump, and a second downhole separator disposed within a wellbore casing disposed in a wellbore. An annular disposal zone is defined between the casing-liner and the wellbore casing. First downhole separator is configured to receive a production fluid from a production zone and generate a hydrocarbon rich stream and a water stream including a solid medium. Production pump is configured to pump the hydrocarbon rich stream from the first downhole separator to a surface unit. Second downhole separator is configured to receive the water stream including the solid medium from the first downhole separator, separate the solid medium to generate a separated water stream, and dispose the solid medium to the annular disposal zone. The system further includes a tube configured to dispose the separated
(Continued)

Figure 1:
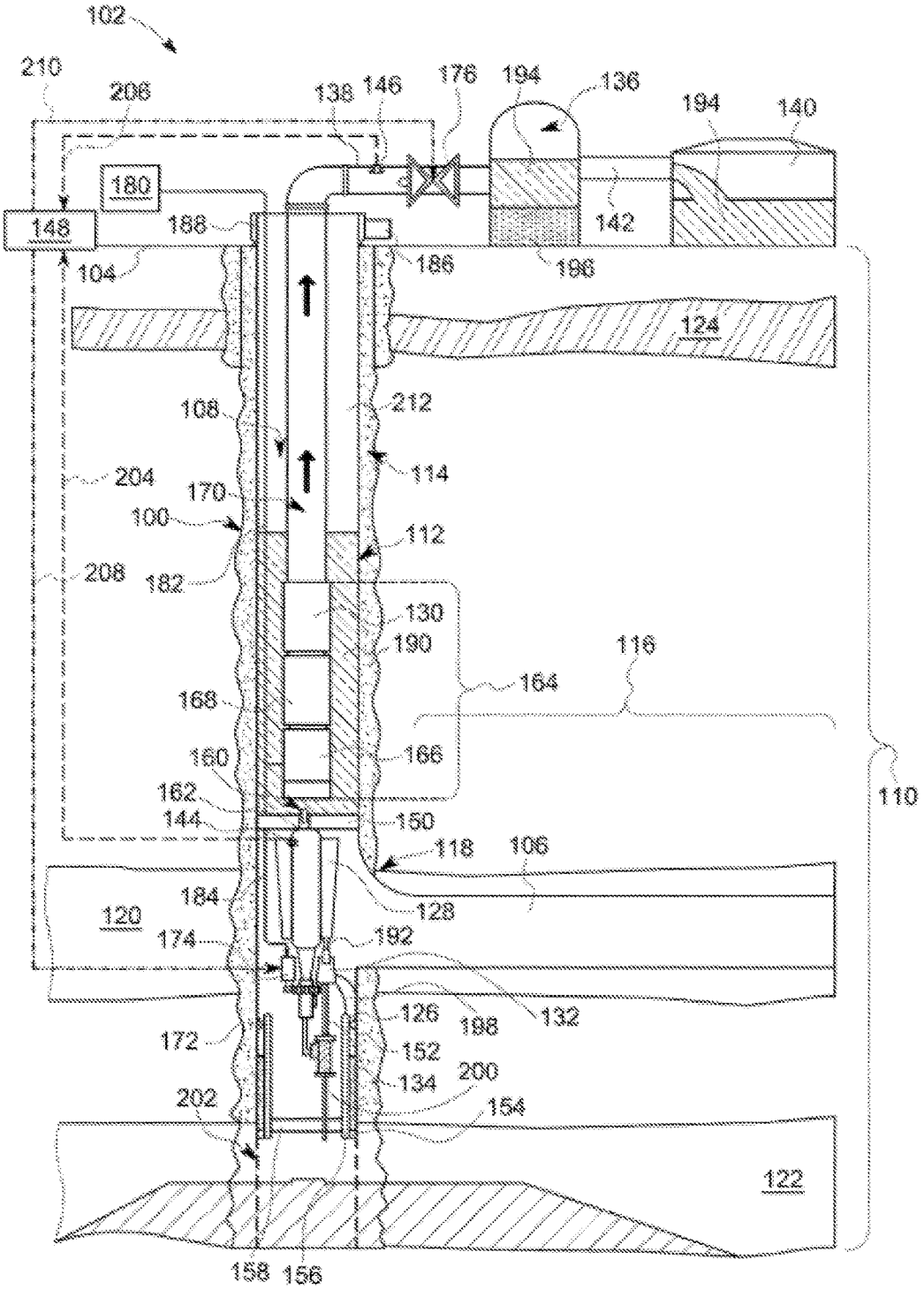

water stream from the second downhole separator to a water disposal zone in wellbore.

23 Claims, 2 Drawing Sheets

(51) Int. Cl.
*E21B 43/12* (2006.01)
*E21B 47/00* (2012.01)
*E21B 49/08* (2006.01)

(52) U.S. Cl.
CPC ..... *E21B 43/128* (2013.01); *E21B 47/00* (2013.01); *E21B 2049/085* (2013.01)

(58) Field of Classification Search
CPC ..... E21B 43/385; E21B 47/00; E21B 49/08; E21B 43/128; E21B 2049/085; G01N 9/00; G01F 1/00
See application file for complete search history.

(56) References Cited

U.S. PATENT DOCUMENTS 5,318,122 A 6/1994 Murray et al.
5,423,387 A 6/1995 Lynde
5,830,368 A 11/1998 Peachey
5,857,519 A 1/1999 Bowlin et al.
5,862,863 A 1/1999 Swisher
5,965,086 A 10/1999 Rose et al.
5,992,524 A 11/1999 Graham
5,996,690 A 12/1999 Shaw et al.
6,015,011 A 1/2000 Hunter
6,033,567 A 3/2000 Lee et al.
6,039,116 A 3/2000 Stevenson et al.
6,068,053 A 5/2000 Shaw
6,070,661 A 6/2000 Kennedy et al.
6,070,667 A 6/2000 Gano
6,080,312 A 6/2000 Bowers et al.
6,082,452 A 7/2000 Shaw et al.
6,131,655 A 10/2000 Shaw
6,173,774 B1 1/2001 Fox
6,189,613 B1 2/2001 Chachula et al.
6,189,616 B1 2/2001 Gano et al.
6,196,313 B1 3/2001 Simons
6,213,208 B1 * 4/2001 Skilbeck ..... B01D 17/00 166/265
6,336,504 B1 1/2002 Alhanati et al.
6,457,522 B1 10/2002 Bangash et al.
6,547,003 B1 4/2003 Bangash et al.
6,845,821 B2 1/2005 Bouma et al.
6,886,636 B2 * 5/2005 Michael ..... E21B 43/385 166/265
7,147,788 B2 12/2006 Tveiten
7,420,183 B2 9/2008 Kaiser et al.
7,610,961 B2 11/2009 Manin et al.
8,261,821 B2 9/2012 Hackworth et al.
8,327,941 B2 12/2012 Hackworth et al.
8,449,750 B2 5/2013 Hamid et al.
8,757,256 B2 6/2014 Li et al.
8,997,870 B2 4/2015 Mcallister et al.
2001/0047872 A1 12/2001 Roberts et al.
2002/0134554 A1 * 9/2002 Schrenkel ..... B01D 21/2455 166/372
2002/0189807 A1 12/2002 Emanuele et al.
2003/0196952 A1 * 10/2003 Kampfen ..... B01D 21/2411 210/512.3
2004/0062140 A1 4/2004 Cadogan et al.
2010/0147511 A1 6/2010 Ollre
2011/0079388 A1 4/2011 Cox
2011/0087476 A1 4/2011 Calvert et al.
2013/0319956 A1 * 12/2013 Tetzlaff ..... B04C 9/00 210/787
2015/0218501 A1 8/2015 Kauling et al.
2016/0333681 A1 * 11/2016 Mazzanti ..... E21B 43/38
2017/0002276 A1 1/2017 Joshi et al.
2017/0002279 A1 1/2017 Joshi et al.
2017/0022796 A1 * 1/2017 Joshi ..... E21B 4/04

FOREIGN PATENT DOCUMENTS

EP 0571771 A2 12/1993
WO WO-9711254 A1 * 3/1997 ..... B01D 17/00
WO 2005118771 A2 12/2005
WO 2012005889 A1 1/2012
WO 2014044612 A1 3/2014
WO 2014058426 A1 4/2014

OTHER PUBLICATIONS

Mahendra Ladharam Joshi et al., Jun. 27, 2016, U.S. Appl. No. 15/193,392.
Mahendra L. Joshi et al., Dec. 14, 2015, U.S. Appl. No. 14/968,292.
Richard Lee Damren et al., Apr. 20, 2015, U.S. Appl. No. 62/149,813.
Qazi N et al., "A neural network model predicting combined separation efficiency of compact axial cyclonic and gravity separator",Computer, Control and Communication, 2009. IC4 2009. 2nd International Conference, 7 Pages.
Wang Zunce et al., "Study on the Flow Pattern of Downhole Oil-Water Separator with Different Inlet Patterns", Bioinformatics and Biomedical Engineering, 2009. ICBBE 2009. 3rd International Conference on, pp. 1-4.
Kjos et al., "Down-Hole Water-Oil Separation and Water Reinjection Through Well Branches", SPE Annual Technical Conference and Exhibition, Dallas, Texas, pp. 689-701, Oct. 22-25, 1995.
Matthews et al., "Application of Downhole Oil/Water Separation Systems in the Alliance Field", SPE, The Third International Conference on Health, Safety and Environment in Oil and Gas Exploration and Production, New Orleans, Louisiana, vol. No. 1, pp. 453-462, Jun. 9-12, 1996.
Loginov et al., "Completion Design for Downhole Water and Oil Separation and Invert Coning", SPE Annual Technical Conference and Exhibition, San Antonio, Texas, pp. 801- 810, Oct. 5-8, 1997.
Verbeek et al., "Downhole Separator Produces Less Water and More Oil", European Petroleum Conference, Conference location: The Hague, Netherlands, vol. No. 1, pp. 429-434, Oct. 20-22, 1998.
Bowers et al., "Development of a Downhole Oil/water Separation and Reinjection System for Offshore Application", SPE Production & Facilities, Offshore Technology Conference, Houston, Texas, vol. No. 15, Issue No. 2, pp. 115-122, May 2000.
Alhoni et al., "Application of Downhole Oil-Water Separation: A Feasibility Study", SPE Asia Pacific Oil and Gas Conference and Exhibition, Jakarta, Indonesia, pp. 1-12, 2003.
Harding et al., "Horizontal Water Disposal Well Performance in a High Porosity and Permeability Reservoir", Journal of Canadian Petroleum Technology, vol. No. 43, Issue No. 11, pp. 21-31, Nov. 2004.
PCT Search Report and Written Opinion issued in connection with related PCT Application No. PCT/EP2016/057971 dated Jun. 10, 2016.
PCT Search Report and Written Opinion issued in connection with related PCT Application No. PCT/US2016/038284 dated Aug. 30, 2016.
PCT Search Report and Written Opinion issued in connection with related PCT Application No. PCT/US2016/042005 dated Oct. 5, 2016.
PCT Search Report and Written Opinion issued in connection with related PCT Application No. PCT/US2016/041439 dated Oct. 13, 2016.
PCT Search Report and Written Opinion issued in connection with corresponding PCT Application No. PCT/US2016/042907 dated Oct. 13, 2016.
Damren, R.L., et al., Inactivation of viruses, GE Co-Pending U.S. Appl. No. 62/149,813, filed Apr. 20, 2015.

(56) References Cited

OTHER PUBLICATIONS

Joshi, M.L., et al., System and method for well partition and downhole seperation of well fluids, GE Co-Pending U.S. Appl. No. 62/195,814, filed Jul. 23, 2015.

* cited by examiner

HYDROCARBON PRODUCTION SYSTEM AND AN ASSOCIATED METHOD THEREOF

CROSS-REFERENCE TO RELATED APPLICATIONS

This patent application claims priority and benefit under 35 U.S.C. § 119(e) from U.S. Provisional Application No. 62/195,814 entitled "SYSTEM AND METHOD FOR WELL PARTITION AND DOWNHOLE SEPARATION OF WELL FLUIDS", filed on Jul. 23, 2015, which is incorporated by reference herein in its entirety.

BACKGROUND

Embodiments of the present invention relate to a hydrocarbon production system, and more particularly, to a system and method for separation and disposal of water and a solid medium from a production fluid.

Non-renewable hydrocarbon fluids such as oil and gas are widely used in various applications for generating energy. Such hydrocarbon fluids are generally extracted from the hydrocarbon wells which extend below a surface of earth to a region where the hydrocarbon fluids are available. Generally, the hydrocarbon fluids are not available in a purified form and are available as a mixture of hydrocarbon fluids, water, sand, and other particulate matter together referred to as a well fluid. Such well fluids are filtered using different mechanisms to extract a hydrocarbon rich stream and a water stream.

Generally, well fluids are extracted from a hydrocarbon well to a surface of the earth and then separated using a separator to produce oil and water. In such an approach, water separated from the well fluids is distributed and transported to a plurality of locations for disposal. One such location may include a water disposal zone located within the hydrocarbon well. However, such a process may increase capital investment and operational costs for water disposal. Further, disposal of water including sand and other particulate matter may result in plugging of the disposal zone. Further, such a process results in increased electric power consumption by the pumps used for transferring the well fluids to the surface. Further, any damage to the pumps due to the presence of the sand and other particulate matter in the well fluids is not prevented.

Accordingly, there is a need for an enhanced system and method for separation and disposal of water and a solid medium from a production fluid.

BRIEF DESCRIPTION

In accordance with one exemplary embodiment, a system for separation and disposal of water and a solid medium from a production fluid is disclosed. The system includes a casing-liner, a first downhole separator, a production pump, a second downhole separator, and a tube. The casing-liner is disposed within a wellbore casing disposed in a wellbore to define an annular disposal zone between the casing-liner and the wellbore casing. The first downhole separator is disposed within the wellbore casing and is configured to receive a production fluid from a production zone and generate a hydrocarbon rich stream and a water stream including a solid medium from the production fluid. The production pump is disposed within the wellbore casing and coupled to the first downhole separator and a surface unit. The production pump is configured to pump the hydrocarbon rich stream from the first downhole separator to the surface unit via a channel. The second downhole separator is disposed above the casing-liner within the wellbore casing and coupled to the first downhole separator. The second downhole separator is configured to receive the water stream including the solid medium from the first downhole separator and separate the solid medium from the water stream to generate a separated water stream. Further, the second downhole separator is configured to dispose the solid medium to the annular disposal zone. The tube is coupled to the second downhole separator and configured to dispose the separated water stream from the second downhole separator to a water disposal zone in the wellbore.

In accordance with another exemplary embodiment, a method for separation and disposal of water and a solid medium from a production fluid is disclosed. The method involves transferring a production fluid from a production zone to a first downhole separator disposed within a wellbore casing disposed within a wellbore. The method further involves generating a hydrocarbon rich stream and a water stream including the solid medium, from the production fluid, using the first downhole separator disposed within the wellbore casing. Further, the method involves feeding the hydrocarbon rich stream from the first downhole separator, using a production pump to a surface unit via a channel. The production pump is disposed within the wellbore casing. The method further involves transferring the water stream including the solid medium, from the first downhole separator to a second downhole separator disposed within the wellbore casing. Further, the method involves separating the solid medium from the water stream to generate a separated water stream, using the second downhole separator. The method further involves disposing the solid medium from the second downhole separator to an annular disposal zone defined between a casing-liner and the wellbore casing. The casing-liner is disposed within the wellbore casing and below the second downhole separator. Further, the method involves disposing the separated water stream from the second downhole separator to a water disposal zone in the wellbore, via a tube.

DRAWINGS

Figure 2:
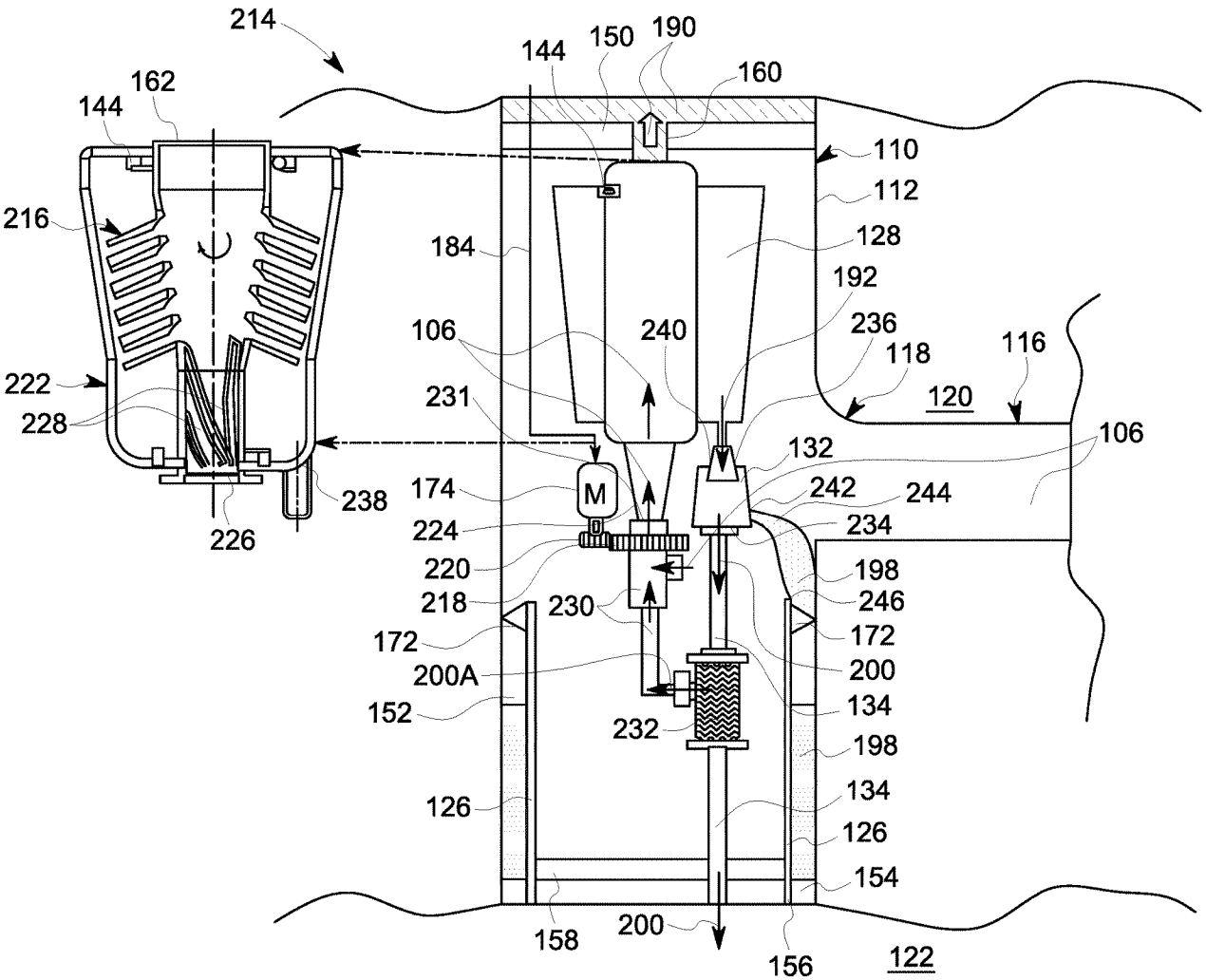

These and other features and aspects of embodiments of the present invention will become better understood when the following detailed description is read with reference to the accompanying drawings in which like characters represent like parts throughout the drawings, wherein:

FIG. 1 is a schematic diagram of a system disposed in a hydrocarbon well for separation and disposal of water and a solid medium from a production fluid in accordance with one exemplary embodiment; and FIG. 2 is a schematic diagram of a portion of the system disposed in the hydrocarbon well in accordance with the exemplary embodiment of FIG. 1.

DETAILED DESCRIPTION

Embodiments of the present invention discussed herein relate to a system and method for separation and disposal of water and solid medium from a production fluid. In one embodiment, the system includes a casing-liner, a first downhole separator, a production pump, a second downhole separator, and a tube disposed within a wellbore casing of a wellbore. The casing-liner is disposed within the wellbore casing to define an annular disposal zone between the casing-liner and the wellbore casing. The first downhole separator is disposed within the well bore casing configured to receive a production fluid from a production zone and generate a hydrocarbon rich stream and a water stream including a solid medium, from the production fluid. The production pump is disposed within the well bore casing and coupled to the first downhole separator and a surface unit and configured to pump the hydrocarbon rich stream from the first downhole separator to the surface unit via a channel. The second downhole separator is disposed above the casing-liner and coupled to the first downhole separator. The second downhole separator is configured to receive the water stream including the solid medium from the first downhole separator and separate the solid medium from the water stream to generate a separated water stream. The second downhole separator is further configured to dispose the solid medium to the annular disposal zone. The tube is coupled to the second downhole separator and configured to dispose the separated water stream from the second downhole separator to a water disposal zone in the wellbore.

In certain embodiments, the first downhole separator separates the water stream including the solid medium from the production fluid, thereby preventing pumping the production fluid including water and solid medium, to the surface unit. As a result, electric power consumption by the production pump and damage of the production pump are prevented. Further, the second downhole separator separates the solid medium from the water stream, thereby preventing disposing the water stream including the solid medium directly into the water disposal zone. As a result, plugging of the water disposal zone is reduced. The system further controls a motor used to drive the first downhole separator and a control valve coupled to the channel based on one or more signals received from a plurality of sensors. The speed of the motor and an outlet pressure of the hydrocarbon rich stream in the channel are adjusted for optimum separation of the water stream including solid medium from the production fluid. The system further includes a jumper cable coupled to the motor and a lift system including the production pump and configured to supply electric power directly from the lift system to the motor. The system further includes sand and proppant proof system disposed covering a gear train coupled to the motor and the first downhole separator. As a result, the gear train is sealed from the production fluid to avoid plugging by the solid medium.

FIG. 1 illustrates a schematic diagram of a system 102 disposed in a hydrocarbon well 100 in accordance with one exemplary embodiment.

The hydrocarbon well 100 extends below a surface 104 of earth to a region where the hydrocarbon fluids are available. The hydrocarbon well 100 is used to produce a production fluid 106 (hereinafter also referred to as "well fluid") which is a mixture of hydrocarbon fluids, water, sand, proppant, and other particulate matter. In some embodiments, the proppant, sand and other particulate matter may be referred to as a "solid medium". The hydrocarbon well 100 includes a wellbore 108 drilled downwards from the surface 104 of the earth. The wellbore 108 extends up to a predetermined depth, for example, about 6500 feet from the surface 104 to form a vertical leg 110. A wellbore casing 112 is disposed within the vertical leg 110. Cement 114 is affixed to an outer surface of the wellbore casing 112. The hydrocarbon well 100 further includes a lateral leg 116 coupled to the vertical leg 110 via a leg junction 118. The lateral leg 116 is used to receive the production fluid 106 from a production zone 120. The hydrocarbon well 100 further includes a water disposal zone 122 located below the production zone 120.

The system 102 includes a casing-liner 126, a first downhole separator 128, a production pump 130, a second downhole separator 132, and a tube 134. The system 102 further includes a surface separator 136 coupled to the production pump 130 via a channel 138. The system 102 also includes a surface unit 140 coupled to the surface separator 136 via an oil outlet manifold 142. The system 102 further includes a first sensor 144, a second sensor 146, and a control unit 148. The casing-liner 126, the first downhole separator 128, the production pump 130, the second downhole separator 132, the tube 134, and the first sensor 144 are disposed within the wellbore casing. The surface separator 136, the surface unit 140, the second sensor 146, and the control unit 148 are disposed on the surface 104 of the earth.

The system 102 further includes a packer 150 disposed within the wellbore casing 112 and located above the first downhole separator 128. The packer 150 is configured to prevent flow of the production fluid 106 directly from the production zone 120 to the production pump 130. The system 102 further includes another packer 154 coupled to a bottom end portion 156 of the casing-liner 126 and the wellbore casing 112. The casing-liner 126 is disposed above the water disposal zone 122. The packer 154 is configured to seal an annular disposal zone 152 formed between the casing-liner 126 and the wellbore casing 112. Further, the system 102 includes yet another packer 158 disposed within the wellbore casing 112 and coupled to the casing-liner 126. The packer 158 is located below the second downhole separator 132 and configured to isolate the water disposal zone 122 from the production zone 120.

In the illustrated embodiment, the casing-liner 126 is disposed below the lateral leg 116 and the second downhole separator 132. The casing-liner 126 is secured inside the wellbore casing 112 via uniformly placed spring loaded centralizer 172. The first downhole separator 128 is disposed proximate to the leg junction 118. In one embodiment, the first downhole separator 128 is an active separator. The system 102 further includes a tube 160 extending through the packer 150 and coupled to a first outlet 162 of the first downhole separator 128. The production pump 130 is disposed above the packer 150 and coupled to the first downhole separator 128 and the surface unit 140. Specifically, the production pump 130 is coupled to the surface separator 136 via a production tubing 170 and the channel 138. The surface separator 136 is coupled to the surface unit 140 via the oil outlet manifold 142. A control valve 176 is coupled to the channel 138. The system 102 further includes a lift system 164 disposed above the packer 150. The lift system 164 includes a motor 166, a gas separator 168, and the production pump 130. In one embodiment, the lift system 164 is an electrical submersible pump (ESP) system.

The second downhole separator 132 is disposed above the casing-liner 126 and coupled to the first downhole separator 128. The second downhole separator 132 is further coupled to the casing-liner 126 and to the tube 134. In one embodiment, the second downhole separator 132 is a passive separator.

The first sensor 144 is operatively coupled to the first outlet 162 of the first downhole separator 128. The second sensor 146 is operatively coupled to the channel 138. In some embodiments, the first sensor 144 may be disposed in the tube 160 coupled the first outlet 162 of the first downhole separator 128. The first sensor 144 and the second sensor 146 are further communicatively coupled to the control unit 148. In one embodiment, the first sensor 144 is a flow sensor and the second sensor 146 is a density meter or a densometer. In some other embodiments, the first sensor 144 may be a pressure sensor.

The system 102 further includes a motor 174 disposed within the wellbore casing 112 and coupled to the first downhole separator 128. The control unit 148 is further communicatively coupled to the motor 174 and the control valve 176. The system 102 further includes a power source 180 coupled to the lift system 164 via a power cable 182. Specifically, the power cable 182 is coupled to the motor 166 of the lift system 164. The power source 180 is disposed at the surface 104 of the earth. The system 102 further includes a jumper cable 184 extending from the power cable 182 and coupled to the motor 174 and the lift system 164. Specifically, the jumper cable 184 is coupled to the motor 166 of the lift system 164. The system 102 further includes a gas outlet manifold 186 coupled to a wellhead 188 disposed at the surface 104 of the earth covering the wellbore casing 112.

During operation, the wellbore 108 receives the production fluid 106 from the production zone 120. Specifically, the production fluid 106 enters the lateral leg 116 through a plurality of perforations (not shown in FIG. 1). The vertical leg 110 receives the production fluid 106 via the lateral leg 116. The production fluid 106 in the wellbore 108 is directed to the first downhole separator 128 via a first jet pump (not shown in FIG. 1) disposed within the wellbore casing 112. The first downhole separator 128 is used to generate a hydrocarbon rich stream 190 and a water stream 192 including a solid medium 198 from the production fluid 106. The tube 160 is used to transfer the hydrocarbon rich stream 190 from the first downhole separator 128 to a portion of the wellbore casing 112 above the packer 150. The gas separator 168 is configured to receive the hydrocarbon rich stream 190 from the first downhole separator 128 via a plurality of inlets (not shown in FIG. 1). The gas separator 168 is used to separate a gaseous medium 212 from the hydrocarbon rich stream 190 before feeding the hydrocarbon rich stream 190 to the production pump 130. The gaseous medium 212 is then filled in the top portion of the wellbore casing 112. The gas outlet manifold 186 is used to discharge the gaseous medium 212 collected within the top portion of the wellbore casing 112 to a discharge storage facility, a compressor, or the like via the wellhead 188.

The production pump 130 is configured to pump the hydrocarbon rich stream 190 received from the first downhole separator 128 to the surface unit 140 via the gas separator 168, the production tubing 170, the channel 138, and the surface separator 136. In such embodiments, the surface separator 136 is configured to generate oil 194 and a water rich stream 196 from the hydrocarbon rich stream 190. The oil outlet manifold 142 transfers the oil 194 from the surface separator 136 to the surface unit 140. The water rich stream 196 in the surface separator 136 may be disposed to a plurality of disposal locations including but not limited to a well-head well (not shown in figures).

The second downhole separator 132 is configured to receive the water stream 192 including solid medium 198 from the first downhole separator 128 via a second jet pump (not shown in FIG. 1). The second downhole separator 132 is used to separate a solid medium 198 from the water stream 192 to generate a separated water stream 200. The second downhole separator 132 is further configured to dispose the solid medium 198 to the annular disposal zone 152. Further, the tube 134 is used to dispose the separated water stream 200 to the water disposal zone 122. In one embodiment, the system 102 may further include a booster pump (not shown in FIG. 1) coupled to the tube 134 and configured to pressurize the separated water stream 200 and then dispose the separated water stream 200 in the water disposal zone 122. Specifically, the wellbore casing 112 includes a plurality of perforations 202 located at the water disposal zone 122 to dispose the separated water stream 200 in the water disposal zone 122.

During operation, the first sensor 144 is configured to measure a flow rate of the hydrocarbon rich stream 190 at the first outlet 162 of the first downhole separator 128. The first sensor 144 is configured to generate a first signal 204 representative of the flow rate of the hydrocarbon rich stream 190. Similarly, the second sensor 146 is configured to measure a density of the hydrocarbon rich stream 190 in the channel 138. The second sensor 146 is configured to generate a second signal 206 representative of the density of the hydrocarbon rich stream 190. The control unit 148 is configured to receive at least one of the first signal 204 and the second signal 206 from the first sensor 144 and the second sensor 146 respectively.

In one embodiment, the control unit 148 is configured to generate and transmit a first control signal 208 to the motor 174 to control a speed of the motor 174 based on at least one of the first signal 204 and the second signal 206. In another embodiment, the control unit 148 is configured to determine an amount of water content in the hydrocarbon rich stream 190 based on the second signal 206. Further, the control unit 148 is configured to generate and transmit a second control signal 210 to the control valve 176 based on at least one of the first signal 204 and the second signal 206. In such an embodiment, the control valve 176 is used to regulate a flow rate of the hydrocarbon rich stream 190 (i.e. an outlet pressure of the hydrocarbon rich stream 190) through the channel 138 to the surface separator 136. In a specific embodiment, the control unit 148 may determine the amount of water content in the hydrocarbon rich stream 190 by comparing obtained value from the second signal 206 with one or more predefined values stored in a look-up table, database, or the like. The speed of the motor 174 and the flow rate of the hydrocarbon rich stream 190 in the channel 138 are adjusted for optimum separation of the water stream including the solid medium 198 from the production fluid 106. In one embodiment, if the obtained value is less than or equal to the predefined value, the control unit 148 may allow continuous flow of the hydrocarbon rich stream 190 through the channel 138. In another embodiment, if the obtained value is greater than the predefined value, the control unit 148 may control an outlet pressure of the hydrocarbon rich stream 190 flowing through the channel 138 by controlling the control valve 176.

In one embodiment, if the amount of water content in the hydrocarbon rich stream 190 is greater than 30 percent, the control unit 148 is configured to control the outlet pressure of the hydrocarbon rich stream 190 flowing through the channel 138 by controlling the control valve 176 based on the second signal 206. As a result, the first downhole separator 128 disposed within the wellbore casing 112 separates the water stream 192 from the production fluid 106 more efficiently. In another embodiment, if the amount of water content in the hydrocarbon rich stream 190 is less than or equal to 30 percent, the control unit 148 may allow continuous flow of the hydrocarbon rich stream 190 through the channel 138.

In one embodiment, the control valve 176 may include a hydraulic choke valve or an electronic regulator valve. The control unit 148 may be a processor-based device. In some embodiments, the control unit 148 may include a proportional-integral-derivative (PID) controller which may be integrated within the control valve 176. In some other embodiments, the control unit 148 may be a general purpose processor or an embedded system. The control unit 148 may be operated via an input device or a programmable interface such as a keyboard or a control panel. A memory module of the control unit 148 may be a random access memory (RAM), read only memory (ROM), flash memory, or other type of computer readable memory. The memory module of the control unit 148 may be encoded with a program for controlling the control valve 176 and the motor 174 based on various conditions at which the control valve 176 and the motor 174 respectively are defined to be operable.

FIG. 2 is schematic diagram of a portion 214 of the system 102 disposed in the hydrocarbon well 100 in accordance with the exemplary embodiment of FIG. 1.

As discussed previously, the first downhole separator 128 is disposed within the wellbore casing 112 and proximate to the leg junction 118. In the illustrated embodiment, the first downhole separator 128 is a rotary separator such as a centrifugal separator including a plurality of rotating elements 216. In some other embodiments, the first downhole separator 128 may be a gravity based separator. In certain other embodiments, the first downhole separator 128 may be a heater-treater, a filtering device, a hydro cyclone based separator, or the like. The motor 174 is coupled to the first downhole separator 128 via a gear train 218 covered by the sand and proppant proof 220. The gear train 218 is used to transfer rotary motion from the motor 174 to the first downhole separator 128. The sand and proppant proof system 220 is used to seal the gear train 218 from the production fluid 106 and avoiding plugging of solid medium 198. Specifically, the gear train 218 is coupled to the plurality of rotating elements 216 disposed within a casing 222 of the first downhole separator 128. In one embodiment, the motor 174 is an electric motor driven by electric power supplied via the jumper cable 184 coupled to the lift system 164. In some other embodiments, the motor 174 may be driven by electric power supplied via a cable extending from the surface 104 of the earth. In certain other embodiments, the motor 174 may be a hydraulic motor. The first jet pump 224 is disposed within the wellbore casing 112 and coupled to an inlet 226 of the first downhole separator 128. Specifically, the first jet pump 224 is disposed proximate to the leg junction 118. The first jet pump 224 includes a plurality of fixed vanes 228 located around the inlet 226 of the first downhole separator 128. The system 102 further includes a motive fluid tube 230 disposed within the wellbore casing 112 and located downstream relative to the first jet pump 224. Specifically, the motive fluid tube 230 is coupled to the booster pump 232 and to an inlet 231 of the first jet pump 224. Further, the booster pump 232 is coupled to a first outlet 234 of the second downhole separator 132 via the tube 134. Specifically, the tube 134 extends into the water disposal zone 122. In one embodiment, the booster pump 232 is a passive pump, such as a hydro cyclone. In some other embodiments, the booster pump 232 may be an active pump, such as the ESP system driven by the electric power supplied via the jumper cable 184.

The second jet pump 236 is coupled to a second outlet 238 of the first downhole separator 128 and to an inlet 240 of the second downhole separator 132. As discussed above, the first outlet 234 of the second downhole separator 132 is coupled to the tube 134. A second outlet 242 of the second downhole separator 132 is coupled to the casing-liner 126 via a liner hanger 244. In one embodiment, the second downhole separator 132 is a gravity based separator device. In some other embodiments, the second downhole separator 132 may be a coalescing filter. In certain other embodiments, the second downhole separator 132 may be a media filter, a filter tube, or the like. A top end portion 246 of the casing-liner 126 is mounted below the second downhole separator 132. The bottom end portion 156 of the casing-liner 126 is disposed above the water disposal zone 122.

During operation, the first jet pump 224 directs the production fluid 106 to the first downhole separator 128. Specifically, the plurality of fixed vanes 228 is used to generate pre-swirl to the production fluid 106 before feeding to the first downhole separator 128. In other words, the first jet pump 224 is used to pressurize the production fluid 106 prior to introducing to the first downhole separator 128 to improve efficiency of the system 102. Specifically, the motor 174 is configured to drive the first downhole separator 128 so as to rotate the plurality of rotating elements 216 at a predetermined speed to generate the hydrocarbon rich stream 190 and the water stream 192 from the production fluid 106. During rotation of the first downhole separator 128, hydrocarbons having a lower molecular weight are separated from the water and the solid medium having a higher molecular weight in the production fluid 106. The first downhole separator 128 is further configured to discharge the water stream 192 including the solid medium 198 to the second jet pump 236 via the second outlet 238 of the first downhole separator 128.

The second jet pump 236 is configured to generate pre-swirl to the water stream 192 including the solid medium 198 before feeding to the second downhole separator 132. In other words, the second jet pump 236 is used to pressurize the water stream 192 including the solid medium 198 prior to introducing to the second downhole separator 132 to improve efficiency of the system 102. The second downhole separator 132 is configured to separate the relatively heavier solid medium 198 from the relatively lighter separated water stream 200. Further, the second downhole separator 132 is configured to dispose the solid medium 198 to the annular disposal zone 152 via the second outlet 242. In one embodiment, the liner hanger 244 is configured to uniformly dispose the solid medium 198 (i.e. 360 degrees) in the annular disposal zone to avoid localized plugging of the 152 casing-liner 126. In certain embodiments, the liner hanger 244 includes an index-able dispenser or rotatable dispenser or screw type dispenser or progressive cavity pump (PCP) dispenser. In such embodiments, the dispenser is driven by the electric power supplied via the jumper cable 184 coupled to the lift system 164. In some other embodiments, the liner hanger 244 may include multiple sand flow lines. Additionally, the second downhole separator 132 is configured to discharge the separated water stream 200 to the tube 134 via the first outlet 234. The booster pump 232 is used to pressurize and dispose the separated water stream 200 in the water disposal zone 122. In such embodiments, the motive fluid tube 230 is used to transfer a portion 200*a* of the separated water stream 200 to the inlet 231 of the first jet pump 224 so as to create suction pressure at the inlet 231 of the first jet pump 224.

In accordance with one or more embodiments discussed herein, an exemplary system and method discloses using a first downhole separator for separating a hydrocarbon rich stream and a water stream including solid medium from a production fluid. There is no additional cost involved for lifting the water stream and processing the water stream at the surface of earth. The exemplary system and method further discloses using a second downhole separator for separating the solid medium from the water stream to generate a separated water stream and then disposing the solid medium in an annular disposal zone and the separated water stream in a water disposal zone. As a result, plugging of the water disposal zone is prevented. Further, the exemplary system and method discloses using a jumper cable to supply power to a motor configured for driving the first downhole separator. Such a configuration prevents the need to supply power from the surface of earth using a separate cable and hence reduces the system complexity. Further, use of a sand and proppant proof system enables sealing the gear train from the production fluid. The use of sensors to determine a flow rate and density of the hydrocarbon rich stream facilitates the first downhole separator to operate at a reasonable efficiency.

While only certain features of embodiments have been illustrated and described herein, many modifications and changes will occur to those skilled in the art. It is, therefore, to be understood that the appended embodiments are intended to cover all such modifications and changes as falling within the spirit of the invention.

The invention claimed is:

1. A system comprising:

a casing-liner disposed within a wellbore casing disposed in a wellbore to define an annular disposal zone between the casing-liner and the wellbore casing;

a first downhole separator disposed within the wellbore casing and configured to receive a production fluid from a production zone and generate a hydrocarbon rich stream and a water stream comprising a solid medium, from the production fluid;

a production pump disposed within the wellbore casing and coupled to the first downhole separator and a surface unit, wherein the production pump is configured to pump the hydrocarbon rich stream from the first downhole separator to the surface unit via a channel;

a second downhole separator disposed above the casing-liner within the wellbore casing and coupled to the first downhole separator and configured to receive the water stream comprising the solid medium from the first downhole separator and separate the solid medium from the water stream to generate a separated water stream, wherein the second downhole separator is configured to dispose the solid medium to the annular disposal zone;

a tube coupled to the second downhole separator and configured to dispose the separated water stream from the second downhole separator to a water disposal zone in the wellbore; and a spring loaded centralizer coupled to the casing-liner and the wellbore casing.

2. The system of claim 1, further comprising a packer disposed within the wellbore casing and located above the first downhole separator, wherein the packer is configured to prevent flow of the production fluid directly from the production zone to the production pump.

3. The system of claim 1, further comprising a packer coupled to a bottom end portion of the casing-liner and the wellbore casing and configured to seal the annular disposal zone, wherein the casing-liner is disposed above the water disposal zone.

4. The system of claim 1, further comprising a packer disposed within the wellbore casing and coupled to the casing-liner, wherein the packer is located below the second downhole separator and configured to isolate the water disposal zone from the production zone.

5. The system of claim 1, further comprising a first jet pump coupled to the first downhole separator and configured to transfer the production fluid from the production zone to the first downhole separator.

6. The system of claim 5, further comprising a second jet pump coupled to the first downhole separator and the second downhole separator, wherein the second jet pump is configured to the transfer the water stream comprising the solid medium from the first downhole separator to the second downhole separator.

7. The system of claim 1, further comprising a surface separator coupled to the production pump and the surface unit, wherein the surface separator is configured to receive the hydrocarbon rich stream from the first downhole separator and generate oil and a water rich stream and feed the oil to the surface unit.

8. The system of claim 1, further comprising a booster pump coupled to the tube and configured to pressurize the separated water stream and dispose the separated water stream in the water disposal zone.

9. The system of claim 8, further comprising:

a motor disposed within the wellbore casing and coupled to the first downhole separator; and a jumper cable coupled to the motor and a lift system including the production pump, wherein the motor is configured to drive the first downhole separator.

10. The system of claim 9, further comprising a first sensor operatively coupled to an outlet of the first downhole separator and a second sensor operatively coupled to the channel, wherein the first sensor is configured to measure a flow rate of the hydrocarbon rich stream and wherein the second sensor is configured to measure a density of the hydrocarbon rich stream.

11. The system of claim 10, further comprising a control unit communicatively coupled to the first sensor and the second sensor and configured to receive at least one of a first signal and a second signal from the first sensor and the second sensor respectively, wherein the first signal is representative of the flow rate of the hydrocarbon rich stream and the second signal is representative of the density of the hydrocarbon rich stream.

12. The system of claim 11, wherein the control unit is communicatively coupled to the motor and configured to control a speed of the motor based on the at least one of the first signal and the second signal.

13. The system of claim 11, further comprising a control valve coupled to the channel and communicatively coupled to the control unit, wherein the control valve is configured to control an outlet pressure of the hydrocarbon rich stream based on the at least one of the first signal and the second signal.

14. The system of claim 1, wherein the first downhole separator comprises a centrifugal separator.

15. A method comprising:

transferring a production fluid from a production zone to a first downhole separator disposed within a wellbore casing disposed within a wellbore;

generating a hydrocarbon rich stream and a water stream comprising a solid medium, from the production fluid, using the first downhole separator disposed within the wellbore casing;

feeding the hydrocarbon rich stream from the first downhole separator, using a production pump to a surface unit via a channel, wherein the production pump is disposed within the wellbore casing;

transferring the water stream comprising the solid medium, from the first downhole separator to a second downhole separator disposed within the wellbore casing;

separating the solid medium from the water stream to generate a separated water stream, using the second downhole separator;

disposing the solid medium from the second downhole separator to an annular disposal zone defined there between a casing-liner and the wellbore casing, wherein the casing-liner is disposed within the wellbore casing and below the second downhole separator; and disposing the separated water stream from the second downhole separator to a water disposal zone in the wellbore, via a tube.

16. The method of claim 15, further comprising preventing flow of the production fluid directly from the production zone to the production pump via a packer located above the first downhole separator, wherein the packer is disposed within the wellbore casing.

17. The method of claim 15, further comprising sealing the annular disposal zone using a packer located within the wellbore casing and above the water disposal zone, wherein the packer is coupled to a bottom end portion of the casing-liner and the wellbore casing.

18. The method of claim 15, further comprising isolating the water disposal zone from the production zone via a packer located below the second downhole separator in the wellbore casing, wherein the packer is coupled to the casing-liner.

19. The method of claim 15, wherein disposing the separated water stream to the water disposal zone comprises pressurizing the water stream using a booster pump coupled to the tube.

20. The method of claim 19, further comprising:

supplying power to a motor disposed within the wellbore casing via a jumper cable coupled to a lift system including the production pump; and driving the first downhole separator using the motor.

21. The method of claim 20, further comprising measuring at least one of a flow rate of the hydrocarbon rich stream using a first sensor and a density of the hydrocarbon rich stream using a second sensor, wherein the first sensor is operatively coupled to an outlet of the first downhole separator and the second sensor is operatively coupled to the channel.

22. The method of claim 21, further comprising controlling a speed of the motor via a control unit based on at least one of a first signal from the first sensor and a second signal from the second sensor, wherein the first signal is representative of the flow rate of the hydrocarbon rich stream and the second signal is representative of the density of the hydrocarbon rich stream.

23. The method of claim 21, further comprising controlling a control valve via a control unit to control an outlet pressure of the hydrocarbon rich stream based on at least one of a first signal from the first sensor and a second signal from the second sensor, wherein the first signal is representative of the flow rate of the hydrocarbon rich stream and the second signal is representative of the density of the hydrocarbon rich stream, wherein the control valve is coupled to the channel.

* * * * *